US007367080B2

(12) United States Patent
Lim et al.

(10) Patent No.: US 7,367,080 B2
(45) Date of Patent: May 6, 2008

(54) UPRIGHT VACUUM CLEANER WITH MOVEMENT CONTROL GRIP

(75) Inventors: Jun-young Lim, Incheon (KR); Yong-won Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/365,505

(22) Filed: Mar. 2, 2006

(65) Prior Publication Data

US 2006/0218742 A1 Oct. 5, 2006

(30) Foreign Application Priority Data

Apr. 1, 2005 (KR) ..... 10-2005-0027616

(51) Int. Cl.
*A47L 9/32* (2006.01)

(52) U.S. Cl. ..... 15/319; 15/340.2; 15/340.3

(58) Field of Classification Search ..... None
See application file for complete search history.

(56) References Cited

U.S. PATENT DOCUMENTS 6,061,869 A * 5/2000 Ettes et al. ..... 15/340.2

2007/0000085 A1* 1/2007 Cipolla et al. ..... 15/340.2

* cited by examiner

*Primary Examiner*—David A Redding
(74) *Attorney, Agent, or Firm*—Greenblum & Bernstein, P.L.C.

(57) ABSTRACT

Disclosed herein is an upright vacuum cleaner having a movement control grip that is capable of performing switch between automatic operation mode and manual operation mode on the movement control grip. The grip comprises a grip body, having a square section, connected to the upper end of a cleaner body while being bent to the cleaner body, upper and lower guide members vertically connected to each other while surrounding the grip body such that the upper and lower guide members can be slid along the outer surface of the grip body, a grip returning unit disposed at the grip body for resiliently returning the upper and lower guide members to their original positions, and a grip sensor unit mounted at the grip body for sensing the forward or rearward movement direction of upper and lower guide members relative to the grip body.

13 Claims, 5 Drawing Sheets

UPRIGHT VACUUM CLEANER WITH MOVEMENT CONTROL GRIP

BACKGROUND OF THE INVENTION

1. Field of the Invention

The present invention relates to an upright vacuum cleaner, and, more particularly, to an upright vacuum cleaner having a movement control grip that is capable of performing switch between automatic operation mode and manual operation mode on the movement control grip.

2. Description of the Related Art

FIG. 1 is a perspective view illustrating a conventional upright vacuum cleaner. As shown in FIG. 1, the conventional upright vacuum cleaner comprises: an upright cleaner body 100 for suctioning air though a suction nozzle 101 and filtering the air to remove foreign matter from the air; a drive unit 200 mounted in the cleaner body 100 for driving the cleaner body 100 such that the cleaner body 100 can be moved forward or rearward; a grip 300 slidably mounted to the upper end of the cleaner body 100, the grip 300 having a sensor 301 for sensing the forward or rearward movement direction of the grip 300; a control unit 400 for controlling the operation of the drive unit 200 such that the cleaner body 100 can be moved forward or rearward based on the forward or rearward movement direction of the grip 300 sensed by the sensor 301.

The drive unit 200 comprises: a drive motor 201 mounted in the cleaner body 100; a drive shaft 202 rotatable in the forward or reverse direction by the drive motor 201; and drive wheels 203 mounted at opposite ends of the drive shaft 202, respectively.

When a user pushes or pulls the grip 300 of the conventional upright vacuum cleaner while holding the grip 300, the forward or rearward movement direction of the grip 300 is sensed by the sensor 301. The sensed information is input to the control unit 400, which rotates the drive motor 201 in the forward or reverse direction based on the sensed information.

However, the sliding grip of the conventional upright vacuum cleaner comprises a plurality of parts, including resilient members, which are connected to one another. As a result, the structure of the grip is very complicated, and therefore, the assembly of the grip takes a great deal of time. Furthermore, the number of parts constituting the grip is large, and therefore, manufacturing costs of the grip are increased.

SUMMARY OF THE INVENTION

Therefore, the present invention has been made in view of the above problems, and it is an object of the present invention to provide an upright vacuum cleaner having a grip the structure of which is simplified and parts of which are reduced in number, thereby reducing manufacturing costs of the grip and time necessary to assemble the grip, and thus reducing manufacturing costs of the upright vacuum cleaner.

It is another object of the present invention to provide an upright vacuum cleaner having a mode selection switch disposed at the lower end of the grip for allowing a user to select automatic or manual operation mode when the user performs a cleaning operation using the upright vacuum cleaner.

In accordance with the present invention, the above and other objects can be accomplished by the provision of an upright vacuum cleaner with a movement control grip, comprising: a suction unit for suctioning foreign matter on a floor; a drive unit; a control unit for controlling the drive unit; a grip slidably mounted to the upper end of a cleaner body; and a grip sensor unit for inputting information sensed based on the sliding direction of the grip to the control unit.

Preferably, the drive unit comprises: a drive motor; a drive shaft rotatable in the forward or reverse direction by the drive motor; and drive wheels mounted at opposite ends of the drive shaft, respectively.

Preferably, the drive motor is a DC motor that is rotatable in alternating directions or a reversible motor, and the control unit controls the drive unit based on a signal sensed when the grip is pushed or pulled such that the drive motor is rotated in the forward or reverse direction.

Preferably, the grip comprises: a grip body connected to the upper end of the cleaner body while being bent to the cleaner body, the grip body having a square section; and upper and lower guide members vertically connected to each other while surrounding the grip body such that the upper and lower guide members can be slid along the outer surface of the grip body. The grip further comprises: a grip returning unit including a folded resilient restoring member disposed in the grip body at one side of the grip body and an insertion hole formed at the middle of the folded resilient restoring member, the grip returning unit being integrally formed at the grip body. The upper guide member is provided at the lower surface thereof with an insertion protrusion, which is inserted in the insertion hole of the grip returning unit for returning the upper and lower guide members to their neutral positions when the upper and lower guide members are slid forward or rearward along the grip body.

Preferably, the grip sensor unit comprises: a sensor pocket formed at the other side of the grip body; and light sensors mounted in the sensor pocket at opposite ends of the sensor pocket, respectively, each of the light sensors having a light emitting part and a light receiving part. The upper guide member is proved at the lower surface thereof with a shutter, which is placed between the light emitting part and the light receiving part of the corresponding light sensor, when the upper and lower guide members are slid forward or rearward along the grip body, for interrupting transmission of light from the light emitting part to the light receiving part.

Preferably, the grip further comprises: a mode selection switch disposed on the upper surface of the front end of the grip body. The mode selection switch is operated to select automatic operation mode, in which the control unit controls the drive motor to be repetitively rotated in alternating directions at an interval of a predetermined period of time, and manual operation mode, in which the control unit controls the drive motor to be rotated in the forward or reverse direction based on information sensed by the grip sensor unit when the grip is pushed or pulled. The mode selection switch is a toggle switch, a tact switch, or a push switch.

Preferably, the grip further comprises: a cover member mounted at the lower surface of the grip body corresponding to the mode selection switch is mounted for covering a lead wire of the mode selection switch.

Preferably, the suction unit comprises a suction nozzle and a filtering member. The suction nozzle has a brush mounted therein, the brush being rotated when power is transmitted to the brush from the drive unit. The filtering member is either a paper filter for filtering air to remove foreign matter from the air by a suction force generated from the drive unit or a cyclonic dust-collection device for performing a dust collecting operation in a cyclonic fashion.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
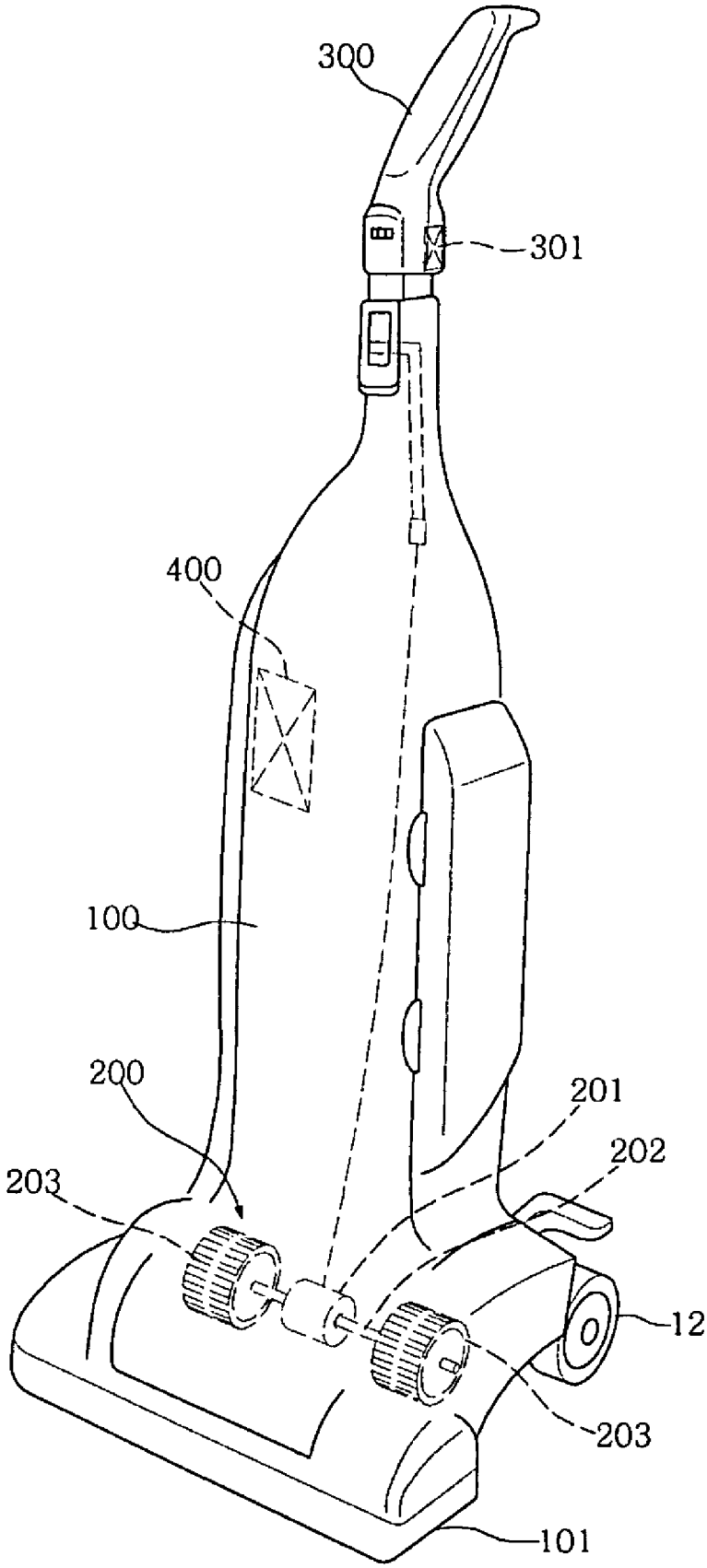
FIG. 1 is a perspective view illustrating a conventional upright vacuum cleaner.
Figure 2:
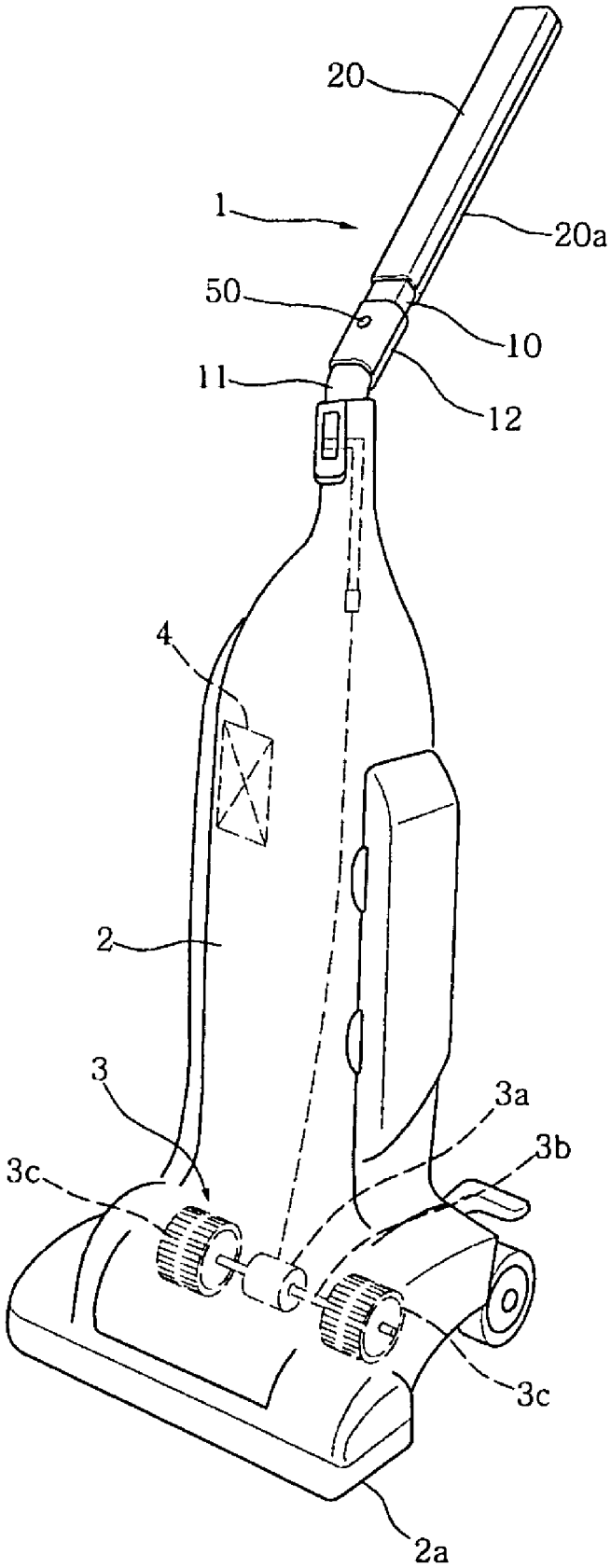
FIG. 2 is a perspective view illustrating an upright vacuum cleaner according to the present invention.
Figure 3:
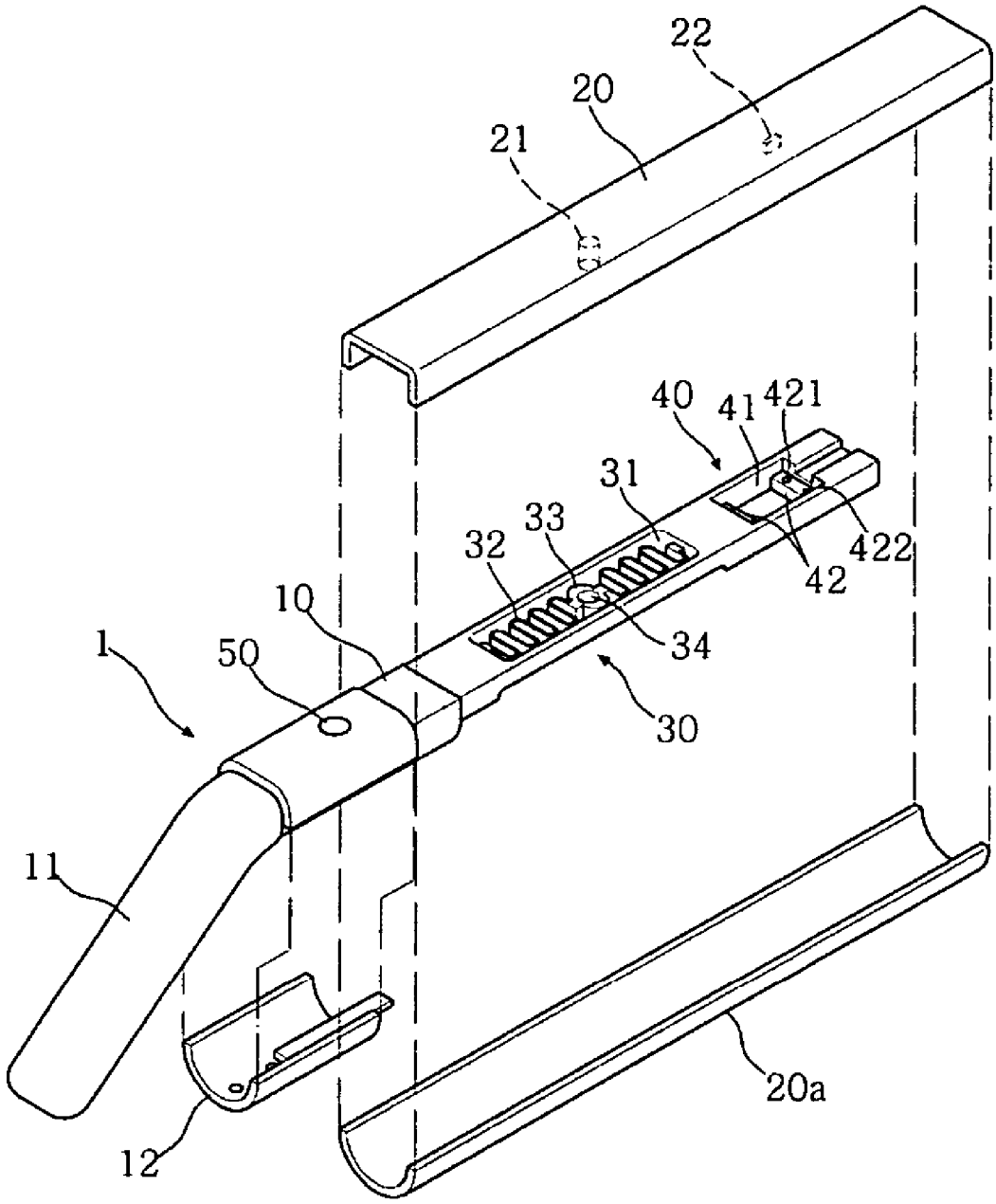
FIG. 3 is an exploded perspective view illustrating the principal part of the upright vacuum cleaner according to the present invention shown in FIG. 2.

FIG. 2 is a perspective view illustrating an upright vacuum cleaner according to the present invention, and FIG. 3 is an exploded perspective view illustrating the principal part of the upright vacuum cleaner according to the present invention shown in FIG. 2.

As shown in FIGS. 2 and 3, the upright vacuum cleaner according to the present invention comprises: a sliding grip 1; an upright cleaner body 2; a drive unit 3 mounted in the cleaner body 2; and a control unit for controlling the drive unit 3.

The cleaner body 2 is provided at the lower end thereof with a suction nozzle 2*a,* in which a brush is disposed for separating foreign matter from the floor. The foreign matter is suctioned into the cleaner body 2 together with air through the suction nozzle 2*a,* and is then separated from the air by a filtering member. The filtering member may be a paper filter for allowing only the air to pass therethrough such that the foreign matter is separated from the air. Alternatively, the filtering member may be a cyclonic dust-collection device for performing a dust collecting operation in a cyclonic fashion.

The drive unit 3 comprises: a drive motor 3*a* mounted in the cleaner body 2; a drive shaft 3*b* rotatable in the forward or reverse direction by the drive motor 3*a;* and a pair of drive wheels 3*c* mounted at opposite ends of the drive shaft 3*b,* respectively. As the drive motor 3*a* is rotated in the forward or reverse direction, the drive wheels 3*c* are also rotated in the forward or reverse direction. As a result, the cleaner body 2 is moved forward or rearward on the floor. The drive motor may be a DC motor that is rotatable in alternating directions or a reversible motor.

The control unit 4 is mounted in the cleaner body 2. In manual operation mode, the control unit 4 controls the drive motor 3*a* to be rotated in the forward or reverse direction based on the movement direction information input from a grip sensor unit 40 of the grip 1. In automatic operation mode, the control unit 4 controls the drive motor 3*a* to be repetitively rotated in alternating directions at an interval of a predetermined period of time.

The movement control grip 1 of the upright vacuum cleaner comprises: a grip body 10 having a bent insertion part 11, which is inserted in the upper end of the cleaner body 2, the grip body 10 having a square section; upper and lower guide members 20 and 20*a* vertically connected to each other while surrounding the grip body 10 such that the upper and lower guide members 20 and 20*a* can be slid along the outer surface of the grip body 10; a grip returning unit 30 disposed at the grip body 10 for resiliently returning the upper and lower guide members 20 and 20*a* to their original positions; and a grip sensor unit 40 mounted at the grip body 10 for sensing the forward or rearward movement direction of upper and lower guide members 20 and 20*a* relative to the grip body 10.

The grip body 10 is connected to the upper end of the cleaner body 2 while being bent to the cleaner body 2 by the insertion part 11. The grip body 10 supports the sliding movement of the upper and lower guide members 20 and 20*a*. Also, the grip body 20 has spaces where the grip returning unit 30 and the grip sensor unit 40 are mounted.

The upper and lower guide members 20 and 20*a* are vertically connected to each other while surrounding the grip body 10. When a user pushes or pulls the upper and lower guide members 20 and 20*a* while holding the upper and lower guide members 20 and 20*a,* the upper and lower guide members 20 and 20*a* are slid forward or rearward along the grip body 10.

The upper guide member 20 is proved at the lower surface thereof with an insertion protrusion 21 and a shutter 22. The upper guide member 20 is coupled with the grip returning unit 30 by means of the insertion protrusion 21 such that the grip 1 is returned to its neutral position whenever the user pushes or pulls the vacuum cleaner. The shutter 22 serves to interrupt transmission of light from a light emitting part 421 to a light receiving part 422, which are provided at each light sensor 42 of the grip sensor unit 40.

The grip returning unit 30 comprises: a location hole 31 formed at the grip body 10; a folded resilient restoring member 32 integrally formed at the grip body 10 and extending in the location hole 31 in the longitudinal direction; an insertion protrusion receiving member 33 formed at the middle of the resilient restoring member 32; and an insertion hole 34 formed in the insertion protrusion receiving member 33.

When the upper and lower guide members 20 and 20*a* are vertically connected to each other while surrounding the grip body 10, the insertion protrusion 21 formed at the lower surface of the upper guide member 20 is inserted into the insertion hole 34 of the grip returning unit 30. When the upper and lower guide members 20 and 20*a* are pushed and pulled by the user, the resilient restoring member 32 is resiliently compressed and extended about the insertion protrusion receiving member 33. When no force is applied to the upper and lower guide members 20 and 20*a,* the upper and lower guide members 20 and 20*a* are returned to their neutral positions.

The grip returning unit 30 is integrally formed at the grip body 10, which is accomplished by injection molding. As a result, the number of parts constituting the grip 1 is decreased. Consequently, the assembly of the grip 1 is simplified, and therefore, the manufacturing costs of the grip 1 are reduced.

The grip sensor unit 40 comprises: a sensor pocket 41 formed at the grip body 10; and light sensors 42 mounted in the sensor pocket 41 at opposite ends of the sensor pocket 41, respectively. Each of the light sensors 42 has a light emitting part 421 and a light receiving part 422.

When the upper and lower guide members 20 and 20*a* are slid forward or rearward along the grip body 10, the shutter 22 formed at the lower surface of the upper guide member 20 is placed between the light emitting part 421 and the light receiving part 422 of the corresponding light sensor 42 mounted in the sensor pocket 41. As a result, transmission of light from the light emitting part 421 to the light receiving part 422 of the corresponding light sensor 42 is interrupted, by which the positions of the upper and lower guide member 20 and 20*a* slid forward or rearward by the user are sensed.

The position where the shutter 22 is placed between the two light sensors 42 is a neutral position, the position where the shutter 22 is placed on the front-side light sensor 42 is a forward-movement position, and the position where the shutter 22 is placed on the rear-side light sensor 42 is a rearward-movement position.

When the shutter 22 is placed in the neutral position, the cleaner body 2 is not operated. When the shutter 22 is placed in the forward-movement position, the front-side light sensor 42 senses the forward-movement position of the shutter 22, and transmits the sensed signal to the control unit 4. The control unit 4 controls the drive motor 3*a* to be rotated in the forward direction such that the cleaner body 2 is moved forward. When the shutter 22 is placed in the rearward-movement position, the rear-side light sensor 42 senses the rearward-movement position of the shutter 22, and transmits the sensed signal to the control unit 4. The control unit 4 controls the drive motor 3*a* to be rotated in the reverse direction such that the cleaner body 2 is moved rearward.

In the sensor pocket 41 is mounted a sensor printed circuit board along with the light sensors 42.

The grip 1 further comprises: a mode selection switch 50 disposed on the upper surface of the front end of the grip body 10. The mode selection switch 50 allows the user to select automatic operation mode, in which the control unit 4 controls the drive motor 3*a* to be repetitively rotated in alternating directions at an interval of a predetermined period of time such that the cleaner body 2 can be alternately moved forward and rearward, and manual operation mode, in which the control unit 4 controls the drive motor 3*a* to be rotated in the forward or reverse direction based on the signal sensed by the corresponding light sensor 42 of the grip sensor unit 40 when the grip 1 is pushed or pulled such that the cleaner body 2 can be moved forward or rearward.

When the automatic operation mode is selected by the user through the mode selection switch 50, the vacuum cleaner is automatically moved in alternating directions at an interval of the predetermined period of time. When the manual operation mode is selected by the user through the mode selection switch 50, on the other hand, the vacuum cleaner is moved forward or rearward as the user pushes or pulls the grip 1. The mode selection switch 50 may be a toggle switch, a tact switch, or a push switch.

The grip 1 further comprises: a cover member 12 mounted at the lower surface of the grip body corresponding to the position of the grip body 10 where the mode selection switch 50 is mounted for covering a lead wire of the mode selection switch 50 exposed to the lower surface of the grip body 10.

Figure 4:
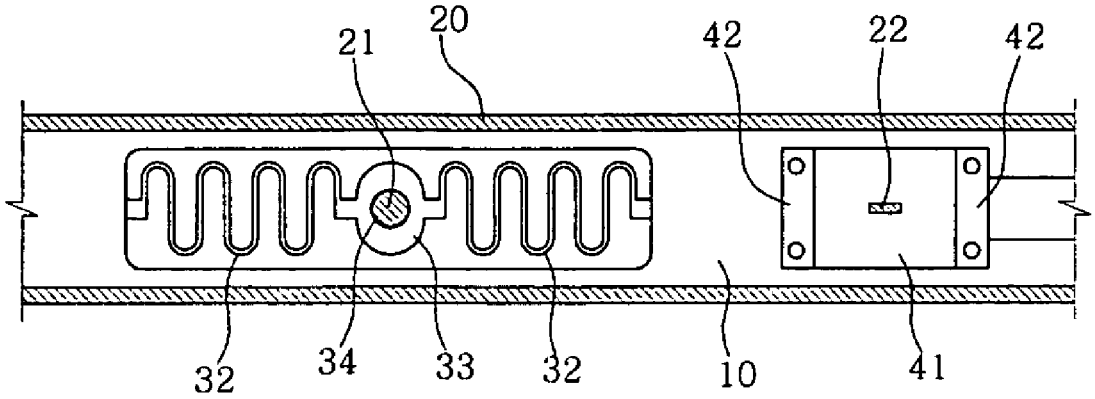
FIG. 4 is a plan view, in section, illustrating the neutral operation of a grip according to the present invention.

FIG. 4 is a plan view, in section, illustrating the neutral operation of the grip 1 according to the present invention.

The insertion protrusion 21 of the upper guide member 20 is inserted in the insertion hole 34 of the insertion protrusion receiving member 33, and no force is applied to the upper guide member 20. As a result, the shutter 22 formed at the lower surface of the upper guide member 20 is placed between the pair of light sensors 42, which are mounted in the sensor pocket 41 of the grip body 10 while being spaced apart from each other. That is, the shutter 22 is placed in the neutral position. Consequently, supply of electric current to the drive unit 3 is interrupted under the control of the control unit 4, and therefore, the operation of the drive motor 3*a* is stopped.

Figure 5:
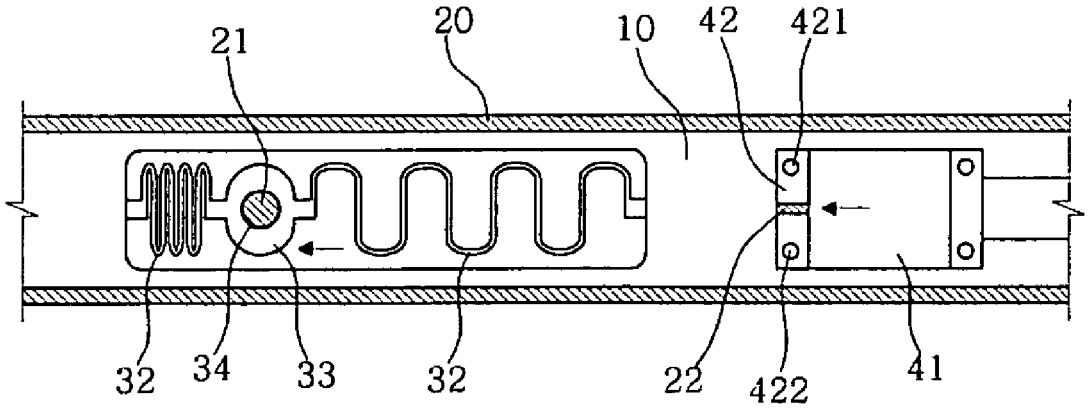
FIG. 5 is a plan view, in section, illustrating the forward-movement operation of a grip according to the present invention.

FIG. 5 is a plan view, in section, illustrating the forward-movement operation of the grip 1 according to the present invention.

When the user pushes the upper guide member 20 forward while holding the upper guide member 20, the insertion protrusion receiving member 33 is moved forward by the insertion protrusion 21 of the upper guide member 20 inserted in the insertion hole 34 of the insertion protrusion receiving member 33.

As the insertion protrusion receiving member 33 is moved forward, the folded front-side resilient restoring member 32, which is disposed in front of the insertion protrusion receiving member 33, is compressed, and at the same time, the folded rear-side resilient restoring member 32, which is disposed in rear of the insertion protrusion receiving member 33, is extended. As a result, the resilient restoring member 32 has a resilient restoring force.

At this time, the shutter 22 of the upper guide member 20 is placed between the light emitting part 421 and the light receiving part 422 of the front-side light sensor 42 disposed at the inner front side of the sensor pocket 41, and therefore, transmission of light from the light emitting part 421 to the light receiving part 422 of the front-side light sensor 42 is interrupted.

As the transmission of light from the light emitting part 421 to the light receiving part 422 of the front-side light sensor 42 is interrupted by the shutter 22, a forward-direction signal is transmitted to the drive unit 3 under the control of the control unit 4. Consequently, the drive wheels 3*c* mounted at the opposite ends of the drive shaft 3*b* of the drive unit are rotated in the forward direction, and therefore, the vacuum cleaner is moved forward.

Figure 6:
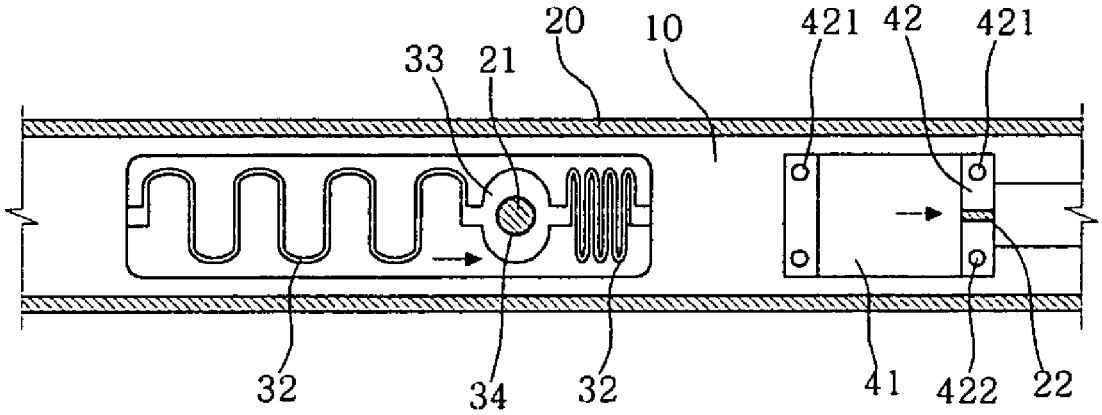
FIG. 6 is a plan view, in section, illustrating the rearward-movement operation of a grip according to the present invention.

FIG. 6 is a plan view, in section, illustrating the rearward-movement operation of a grip according to the present invention.

When the user pulls the upper guide member 20 rearward while holding the upper guide member 20, the insertion protrusion receiving member 33 is moved rearward by the insertion protrusion 21 of the upper guide member 20 inserted in the insertion hole 34 of the insertion protrusion receiving member 33.

As the insertion protrusion receiving member 33 is moved rearward, the folded rear-side resilient restoring member 32 is compressed, and at the same time, the folded front-side resilient restoring member 32 is extended. As a result, the resilient restoring member 32 has a resilient restoring force.

At this time, the shutter 22 of the upper guide member 20 is placed between the light emitting part 421 and the light receiving part 422 of the rear-side light sensor 42 disposed at the inner rear side of the sensor pocket 41, and therefore, transmission of light from the light emitting part 421 to the light receiving part 422 of the rear-side light sensor 42 is interrupted.

As the transmission of light from the light emitting part 421 to the light receiving part 422 of the rear-side light sensor 42 is interrupted by the shutter 22, a rearward-direction signal is transmitted to the drive unit 3 under the control of the control unit 4. Consequently, the drive wheels 3*c* mounted at the opposite ends of the drive shaft 3*b* of the drive unit are rotated in the reverse direction, and therefore, the vacuum cleaner is moved rearward.

As apparent from the above description, the grip returning unit of the grip is integrally formed at the grip body of the grip, which is accomplished by injection molding without the provision of springs or rubber. Consequently, the present invention has the effect of accomplishing easy and convenient manufacture and assembly of the grip.

Furthermore, the mode selection switch is disposed on the grip for allowing a user to select automatic operation mode and manual operation mode. Consequently, the present invention has the effect of improving convenience in use.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An upright vacuum cleaner with a movement control grip, comprising:

a suction unit that suctions foreign matter on a floor;

a drive unit;

a control that controls the drive unit;

a grip slidably mounted to the upper end of a cleaner body; and a grip sensor that inputs information sensed based on the sliding direction of the grip to the control;

wherein the grip comprises:

a grip body connected to the upper end of the cleaner body while being bent to the cleaner body, the grip body having a square section; and upper and lower guide members vertically connected to each other while surrounding the grip body such that the upper and lower guide members can be slid along the outer surface of the grip body; and a grip returning unit including a folded resilient restoring member disposed in the grip body at one side of the grip body and an insertion hole formed at the middle of the folded resilient restoring member, the grip returning unit being integrally formed at the grip body.

2. The cleaner as set forth in claim 1, wherein the upper guide member is provided at the lower surface thereof with an insertion protrusion, which is inserted in the insertion hole of the grip returning unit for returning the upper and lower guide members to their neutral positions when the upper and lower guide members are slid forward or rearward along the grip body.

3. An upright vacuum cleaner with a movement control grip, comprising:

a suction unit that suctions foreign mailer on a floor;

a drive unit;

a control that controls the drive unit;

a grip slidably mounted to the upper end of a cleaner body; and a grip sensor that inputs information sensed based on the sliding direction of the grip to the control;

wherein the grip comprises:

a grip body connected to the upper end of the cleaner body while being bent to the cleaner body, the grip body having a square section; and upper and lower guide members vertically connected to each other while surrounding the grip body such that the upper and lower guide members can be slid along the outer surface of the grip body; and wherein the grip sensor unit comprises:

a sensor pocket formed at the other side of the grip body.

4. The cleaner as set forth in claim 3, wherein the grip sensor further comprises:

light sensors mounted in the sensor pocket at opposite ends of the sensor pocket, respectively, each of the light sensors having a light emitting part and a light receiving part.

5. The cleaner as set forth in claim 4, wherein the upper guide member is proved at the lower surface thereof with a shutter, which is placed between the light emitting part and the light receiving part of the corresponding light sensor, when the upper and lower guide members are slid forward or rearward along the grip body, to interrupt transmission of light from the light emitting part to the light receiving part.

6. The cleaner as set forth in claim 5, wherein the control controls the drive motor to be rotated in the forward or reverse direction as the transmission of light from the light emitting parts to the corresponding light receiving parts of the light sensors is alternately interrupted by the shutter.

7. The cleaner as set forth in claim 1, wherein the grip further comprises: a mode selection switch disposed on the upper surface of the front end of the grip body.

8. The cleaner as set forth in claim 7, wherein the mode selection switch is operated to select automatic operation mode, in which the control controls the drive motor to be repetitively rotated in alternating directions at an interval of a predetermined period of time, and manual operation mode, in which the control controls the drive motor to be rotated in the forward or reverse direction based on information sensed by the grip sensor when the grip is pushed or pulled.

9. The cleaner as set forth in claim 8, wherein the mode selection switch is a toggle switch, a tact switch, or a push switch.

10. The cleaner as set forth in claim 8, wherein the grip further comprises:

a cover member mounted at the lower surface of the grip body corresponding to the mode selection switch is mounted to cover a lead wire of the mode selection switch.

11. The cleaner as set forth in claim 3, wherein the suction unit comprises a suction nozzle and a filtering member.

12. The cleaner as set forth in claim 11, wherein the suction nozzle has a brush mounted therein, the brush being rotated when power is transmitted to the brush from the drive unit.

13. The cleaner as set forth in claim 11, wherein the filtering member is either a paper filter that filters air to remove foreign matter from the air by a suction force generated from the drive unit or a cyclonic dust-collection device that performs a dust collecting operation in a cyclonic fashion.

* * * * *